United States Patent [19]

Imahashi

[11] Patent Number: 4,748,775

[45] Date of Patent: Jun. 7, 1988

[54] WORK HOLDING DEVICE IN WORK GRINDING AND POLISHING MACHINE

[75] Inventor: Takahiro Imahashi, Kokubunji, Japan

[73] Assignee: Suzuki Shoji Patent Office, Tokyo, Japan

[21] Appl. No.: 23,661

[22] Filed: Mar. 9, 1987

Related U.S. Application Data

[62] Division of Ser. No. 810,709, Dec. 19, 1985, Pat. No. 4,667,446.

[30] Foreign Application Priority Data

Dec. 28, 1984 [JP] Japan ..... 59-279803
Oct. 1, 1985 [JP] Japan ..... 60-150486[U]

[51] Int. Cl.[4] ..... B24B 3/36
[52] U.S. Cl. ..... 51/229; 51/218 R; 51/218 A
[58] Field of Search ..... 51/229, 217 R, 217 P, 51/217 T, 217 A, 218 R, 218 A, 218 P

[56] References Cited

U.S. PATENT DOCUMENTS 1,636,671 7/1927 Anzelewitz ..... 51/229
3,435,569 4/1969 Stanley ..... 51/229
3,439,456 4/1969 Bailey ..... 51/229

*Primary Examiner*—Frederick R. Schmidt
*Assistant Examiner*—Robert A. Rose
*Attorney, Agent, or Firm*—Wenderoth, Lind & Ponack

[57] ABSTRACT

A work holding apparatus is used in grinding and polishing very hard and brittle tools, such as monocrystalline or polycrystalline diamond tools, diamond indenters, diamond knives, etc.

The work holding apparatus includes a support member to be mounted on the work table, and work operating devices capable of vertical movement, capable of forward and backward movement, and capable of swing motion about a horizontal shaft and which are all connected one after another to the support member. The swing device is connected to a swing arm, to which a tool holder is attached via the vertical movement device and swivel device.

4 Claims, 14 Drawing Sheets

14

WORK HOLDING DEVICE IN WORK GRINDING AND POLISHING MACHINE

CROSS REFERENCE TO RELATED APPLICATONS

This is a divisional application of Ser. No. 810,709, filed Dec. 19, 1985, now U.S. Pat. No. 4,667,446.

BACKGROUND OF THE INVENTION

1. Field of the Invention

The present invention relates generally to work handling technology, and more specifically to a work holding device in a work handling machine designed to grind and polish very hard and brittle tools such as diamond tools.

2. Description of the Prior Art

In all conventional work handling machines designed to grind and polish very hard and brittle tools such as diamond bits, most of the operation required for that purpose is manually carried out by a human operator, because there is no adequate means available to relieve the operator from the manual operation.

SUMMARY OF THE INVENTION

It is therefore one object of the present invention to offer means that can relieve the operator from most of the manual operation.

Another object of the present invention is to keep track of the contact of the portion of a tool to be worked with regard to its scaife surface so that the contact condition can be controlled numerically, thereby enabling the contact condition to be reproduced repeatedly and allowing the pressure of the contact to be adjusted to any desired value.

In order to accomplish those objects, the work holding apparatus provided by the present invention, which is to be mounted on the tool grinding and polishing machine, includes a support member which is to be placed on the work table an operative element that causes work or a tool to travel perpendicularly to the table, an operative element that causes the work to travel transversely to the table, and an operative swing element that swings around its horizontal shaft, all of those operative elements being connected sequentially to the support member. The swing element includes a swing arm, to which a tool holder is attached through the perpendicularly traveling element and a further swivel element so that the tool holder can turn around its horizontal shaft. Each of the operative elements can be adjusted so that the tip of the tool or work, which is carried by the tool holder, can be brought into contact with the scaife surface. The adjustment of those elements can easily be made by even an unexperienced operator, who can manipulate the tool holder for all work under the identical grinding or polishing conditions. This has solved the problem that the conventional machines have encountered.

As its construction is briefly described, the tool polishing tang includes a tang column, on one side of which a swivel shaft slide bracket is mounted so that it can adjustably travel up and down. The swivel shaft slide bracket carries a swivel shaft on its other side, which traverses the bracket so that it can be rotated. Below the swivel shaft is disposed a swing shaft bearing, which rotatably supports a swing shaft with its one end traversing the swing shaft bearing, to which a swing arm is secured at one end thereof. The other end of the swing arm has an R-set slide which can adjustably travel up and down. The R-set slide carries a tool holder bracket which is fixed on one side to the R-set slide so that it can travel transversely across the R-set slide. The tool holder bracket carries a tool holder which is rotatably supported on its other side by a horizontal shaft which is also carried by the tool holder bracket.

In the construction described above, the tool holder has two prongs which are adapted to hold a tool or work having a rectangular cross-section, for example. In its preferred form, the tool holder may include a threaded hole adapted to mate with a tool set screw, which is provided through one lateral side, a rod extending from the lateral wall perpendicular to the above lateral side, which is adapted to engage a hole made in the tool holder bracket, and a worm gear mounted on one side of the other lateral side which is formed to provide an arc surface. In its one form, the R-set slide has a longitudinal groove on one side, which engages the swing arm, and a protrusion on the other side extending across the slide, which engages the corresponding groove provided across the tool holder bracket. The swing arm carries the swing shaft at the bottom of one lateral wall, one end of which is secured to the swing arm at a right angle to the same, and has a longitudinal protrusion on the other side which engages the corresponding longitudinal groove on the R-set slide.

BRIEF DESCRIPTION OF THE DRAWINGS

The above and other constructional features of the present invention will become more clear from the detailed description of several preferred embodiments that follows hereinafter, by referring to the accompanying drawings, in which.

DETAILS OF THE PREFERRED EMBODIMENTS

Figure 2:
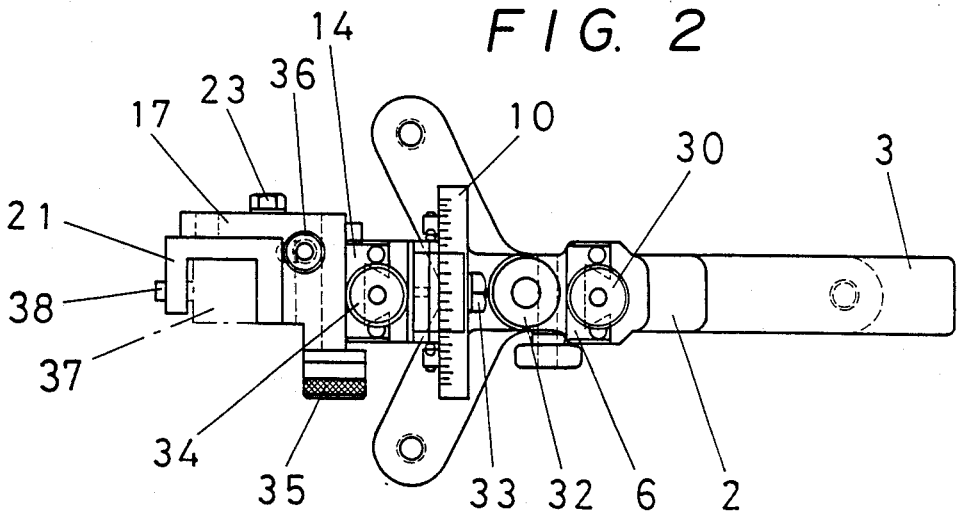
FIG. 2 is a plan view of the embodiment shown in FIG. 1.
Figure 3:
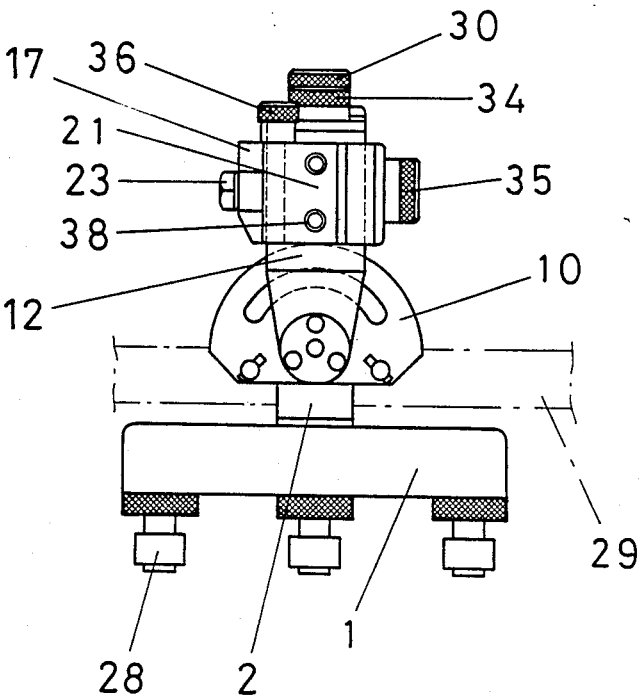
FIG. 3 is a side elevation of the embodiment shown in FIG. 1.

The following is the detailed description of the various preferred embodiments of the present invention. Among those, FIGS. 1 through 3 illustrate the first embodiment, which is first described.

Figure 1:
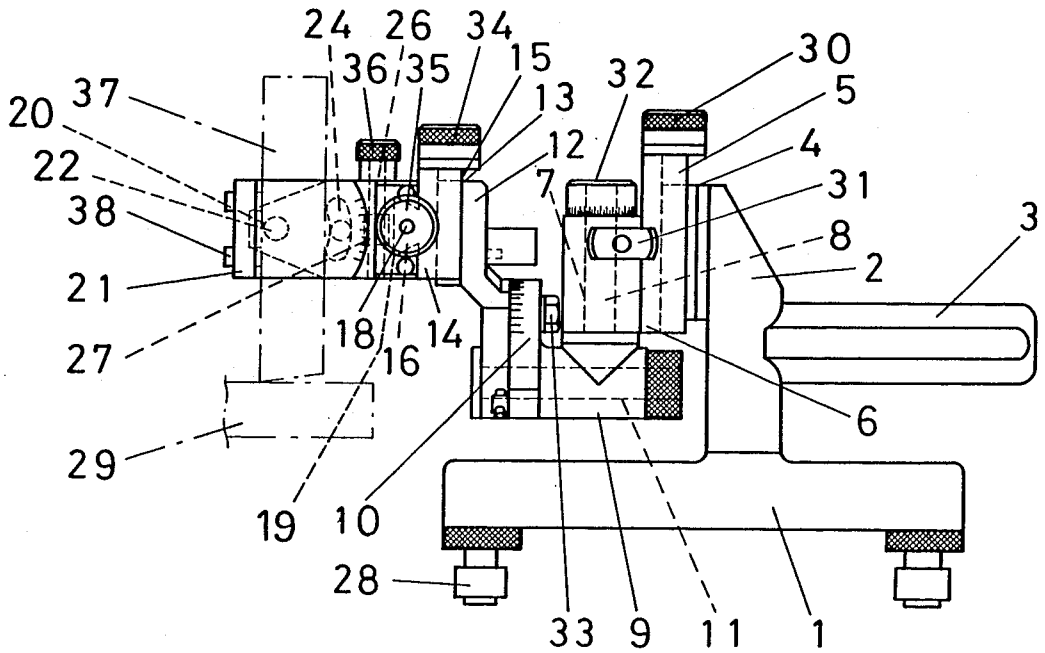
FIG. 1 is a front view of one preferred embodiment of the present invention.

In FIG. 1, a tang Y-base 1 has a tang column 2 whose bottom is rigidly secured to the tang Y-base such that it extends upright from the central portion of the Y-base 1. The tang column 2 has a grip or handle 3, which extends laterally from the right-side wall (as shown in FIG. 1). The tang column 2 also has a protrusion 4 which extends laterally from the upper left-side wall, running longitudinally along the upper left-side wall, inside which a threaded rod 5 is accommodated. The protrusion 4 engages the corresponding longitudinal groove on a swivel shaft slide bracket 6 such that the portion of the threaded rod 5 on one side thereof can engage the corresponding portion of the longitudinal groove that is internally threaded (which is not shown). The swivel shaft slide bracket 6 has a longitudinally elongated aperture 7 on its other side, through which a swivel shaft 8 is rotatably inserted. The swivel shaft 8 has a swing shaft bearing 9 secured to the bottom end thereof such that it is placed at a right angle with respect to the swivel shaft. A protractor 10 is provided on one side of the swing shaft bearing 9, and is mounted vertically with regard to the swing shaft bearing 9. The swing shaft bearing 9 accommodates a swing shaft 11 which is rotatably inserted through the bearing 9, one end of the swing shaft 11 being connected to the lower portion of a swing arm 12 shows upper portion extends vertically. The upper portion of the swing arm 12 has a tab 13 extending laterally from its longitudinal edge, which engages the corresponding longitudinal groove formed on one side of an R-set slide 14. The tab 13 accommodates a threaded rod 15 which is inserted through the tab 13.

Figure 9:
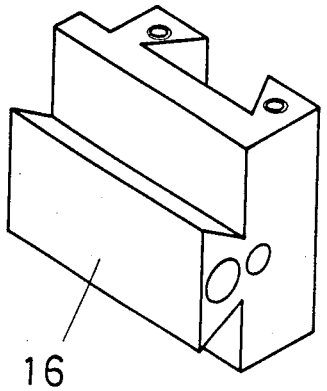
FIG. 9 is an enlarged perspective view of the R-set slide.

Thus, part of the threaded rod 15 engages the corresponding part of the above groove that is also threaded inside. The R-set slide 14, shown in FIG. 9, has a tab 16 extending laterally from the other side thereof, which engages the corresponding lateral groove 19 formed on one side of a tool holder bracket 17. The tab 16 houses a threaded rod 18, part of which engages the corresponding threaded part formed inside the lateral groove 19.

Figure 7:
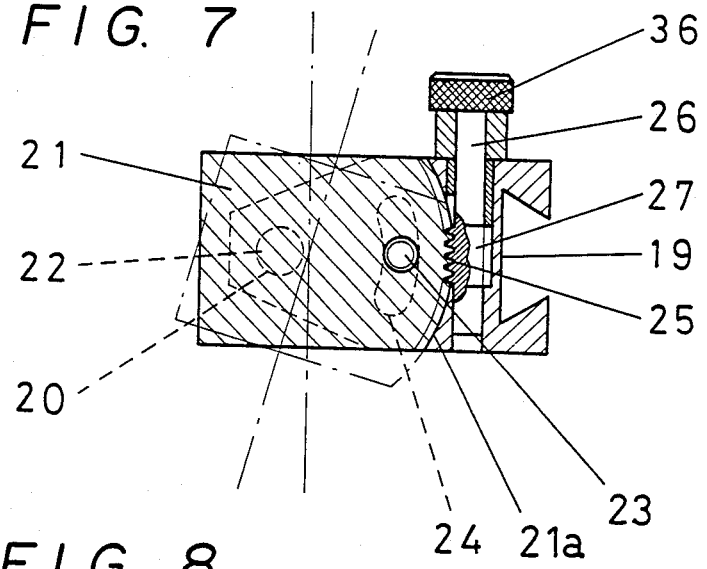
FIG. 7 is a cross-section of FIG. 4, illustrating the relative positions between the tool holder L-bracket and the tool holder.
Figure 8:
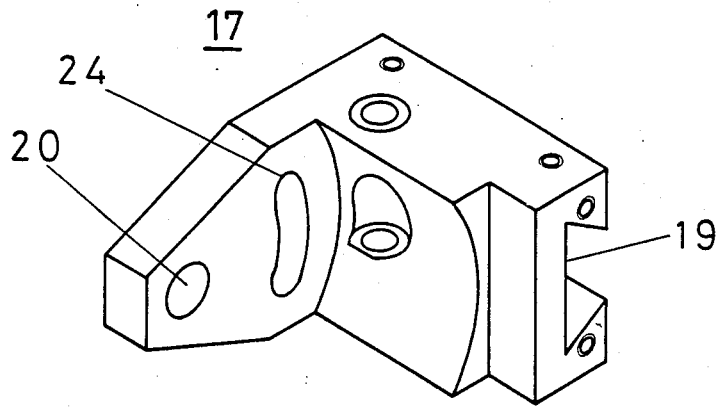
FIG. 8 is an enlarged perspective view of the L-bracket.
Figure 10:
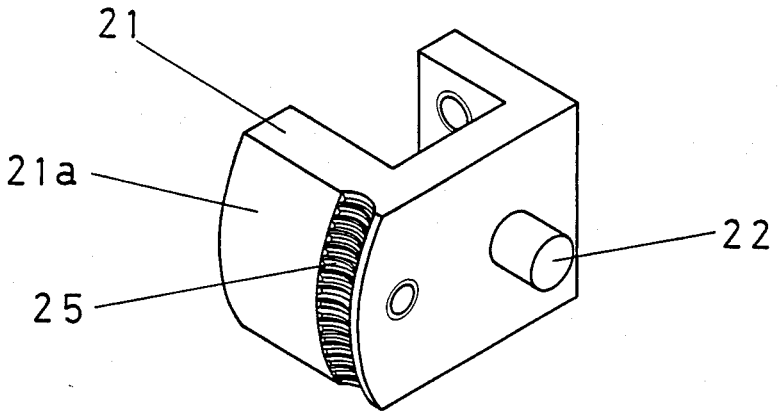
FIG. 10 is an enlarged perspective view of the tool holder.

The tool holder bracket 17, shown in FIG. 8, has a lateral hole 20 traversing the other side thereof, through which a horizontal shaft 22 extending from one lateral side of a tool holder 21 is rotatably inserted. The tool holder 21, shown in FIGS. 7 and 10, has a stud bolt 23 which engages an arc-like aperture 24 on the tool holder bracket 17. The tool holder 21 also has an arc-like surface 21*a* formed on the other side end, in one side of which a worm gear 25 is formed. The tool holer bracket 17 has a worm rod 26 traversing it in the longitudinal direction, the worm rod 26 having a worm 27 which engages the worm gear 25 (see FIG. 7).

Figure 11:
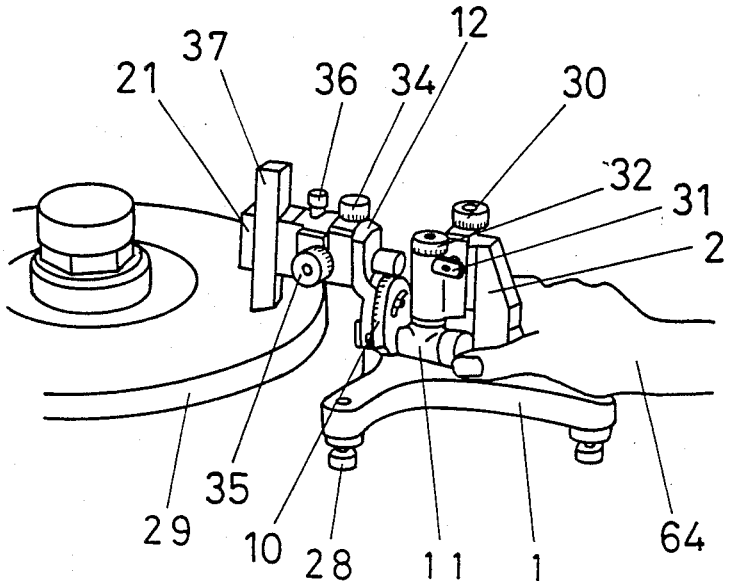
FIG. 11 is a perspective view of the tang shown in FIG. 1, which is presented to explain how the tang is used.

The operation of the above-described embodiment is as follows. First, the tang Y-base 1 is placed on the work table as shown in FIG. 11. Then, height adjustment bolts 28 located beneath the base 1 are adjusted so that the center line through the swivel shaft 8 is brought perpendicular to the surface of the lapping element 29. Next, the knob 30 on the threaded rod 5 is rotated to raise or lower the swivel shaft slide bracket 6, so that the center line through the swing shaft 11 can then be aligned with the upper face of the lapping element 29. After that, a set screw 31, which now locks the swivel shaft 8, is rotated to release the swivel shaft 8 from its locked state. After ensuring that the direction of the swivel shaft bearing 9 has been determined by looking at the swivel shaft dial indicator 32, the set screw 31 is rotated back, placing the swivel shaft 8 in its locked condition.

The tightening bolt 33 is then released, allowing the right or left angle to the swing arm 12 to be adjusted. After determining the angle of the swing arm 12 (in FIG. 3), the bolt 33 is retightened to fix the swing arm 12. The knob 34 is also rotated to determine the height of the R-set slide 14, then the knob 35 is rotated to determine the forward or backward position of the tool holder bracket 17, then the knob 36 is operated to turn the tool holder 21 about its horizontal shaft 22 so that the tip clearance angle of the bit 37 (the angle with regard to the lapping element surface) can be determined, and the angle thus obtained is maintained by retightening the bolt 23. A bolt 38 is used for fixing the bit 37.

FIG. 11 illustrates how the above-described embodiment is actually used. The human operator grips the tang column 2 with his hand 64, as shown in FIG. 11, and grinds and polishes the tip of the bit 37 by bringing it in contact with the surface 29 of the lapping element. It has been described that prior to this operation, the swing angles of the swing arm 12 and the height of the tip of the bit 37 have previously been determined.

Figure 4:
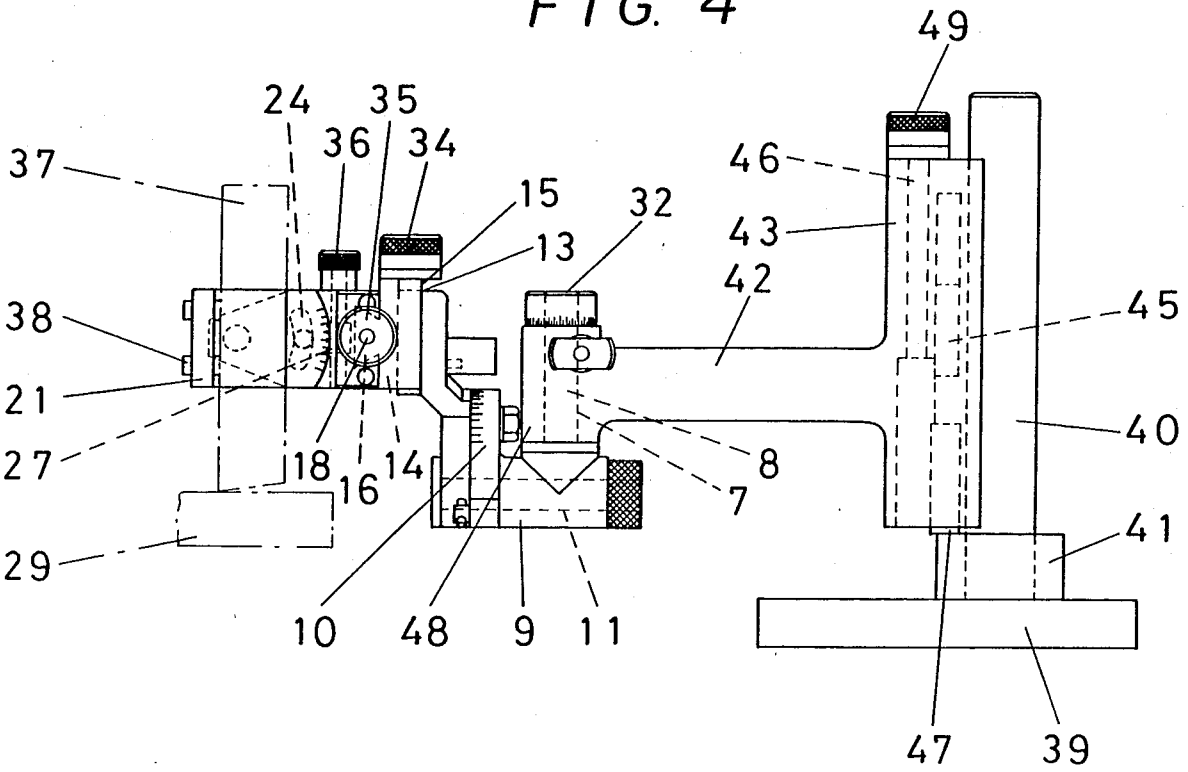
FIG. 4 is a front view of another preferred embodiment of the present invention.
Figure 5:
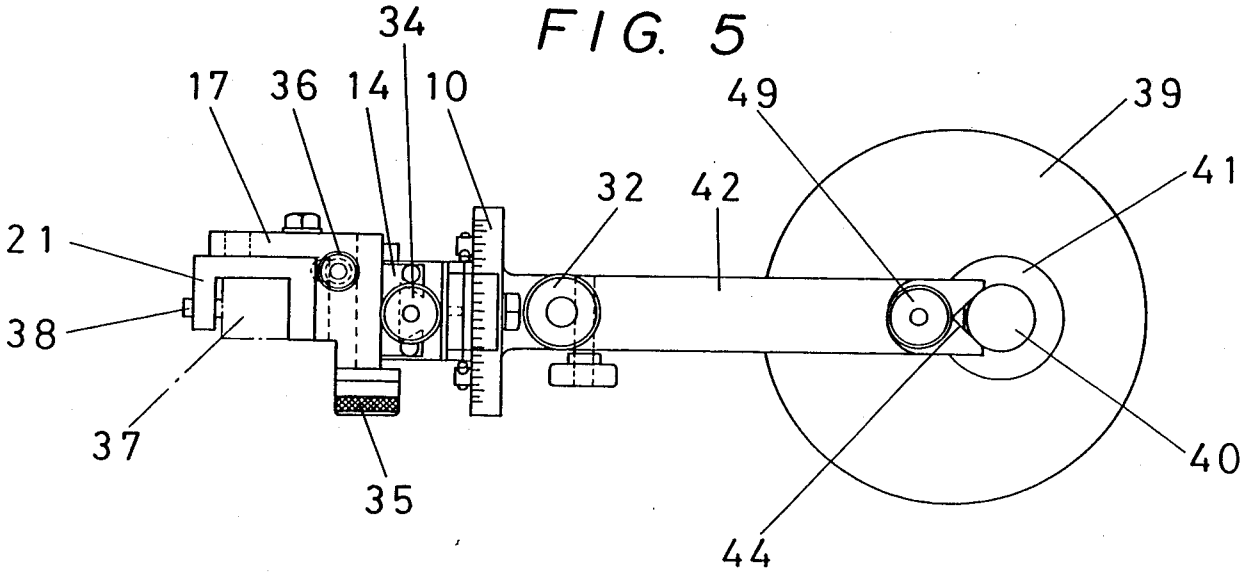
FIG. 5 is a plan view of the embodiment shown in FIG. 4.
Figure 6:
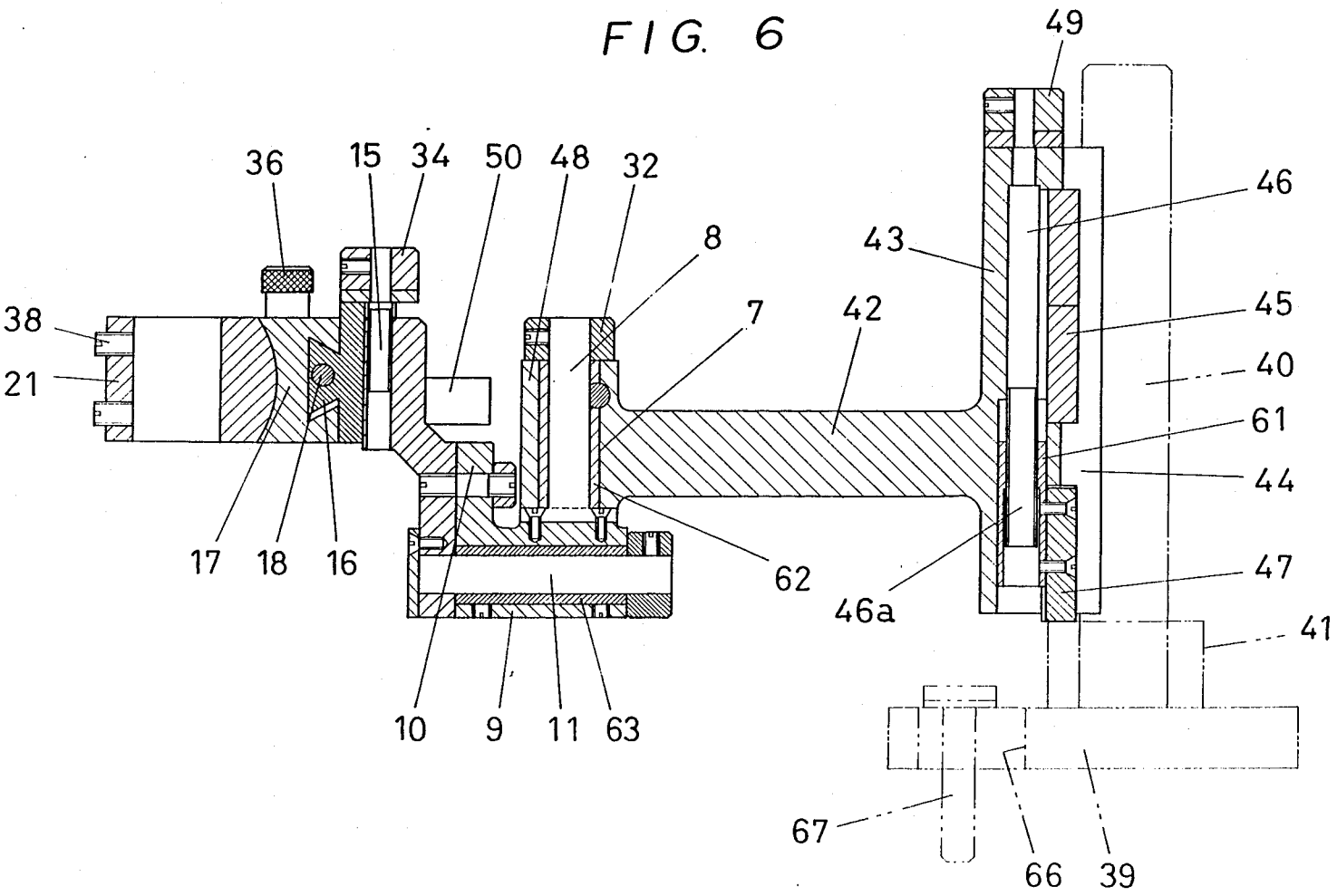
FIG. 6 is a longitudinal cross-section of FIG. 4, as viewed on an enlarged scale.

Another embodiment of the present invention is next described by referring to FIGS. 4 through 6. This embodiment is smilar to the preceding embodiment except that it incorporates a tang column construction which is different from that in the preceding embodiment. Each part or element in the tool holder is identical to each of the corresponding parts or elements in the preceding embodiment. Therefore, the following description is restricted to the those different parts or elements.

The tang column construction includes a disk-like stand rod base 39, on which a vertical stand rod 40 is disposed. The stand rod 40 has a collar 41 at its base, which is fitted around the stand rod 40. A tang frame 42 has a longitudinally extending stand frame 43 on one side, and the stand frame 43 has a V-cut groove 44 running longitudinally on the side facing the stand rod 40. The stand frame 43 engages the stand rod 40 by means of the V-cut groove 44 (FIG. 5). Magnets 45 are housed inside the V-cut groove 44. As the stand rod 40 is made of ferromagnetic material, those magnets attract the stand rod 40 magnetically. Thus, the stand rod 40 and stand frame 44 can be joined together by the magnetic attraction.

As shown in detail in FIG. 6, the stand frame 43 contains a rod 46 on the side opposite the V-cut groove 44, which extends longitudinally in parallel with the groove 44. The rod 46 has a lower threaded portion 46*a* which engages a threaded tube 61 to which a slide key 47 is fixed so that it can travel up and down along the V-cut groove 44. The tang frame 42 has a swivel bracket 48 on the other end thereof, and the swivel bracket 48 has an aperture 7 traversing it. A sleeve 62 is fitted into the aperture 7, through which a swing shaft 8 is rotatably inserted. A swing shaft bearing 9 which is disposed across the swivel shaft 8 is rigidly mounted to the lower end of the swivel shaft 8. The swing shaft bearing 9 has a sleeve 63 fitted inside, through which a swing shaft 11 is inserted. As the part of the construction in which the tool holder 21 is to be mounted is the same as that for the preceding embodiment, it may be mounted in the same manner as described in the preceding embodiment.

For the operation of the above-described embodiment, the knob 49 is rotated to cause the slide key 47 to slide up or down, thus adjusting the height of the tang frame 42. The height of the swing shaft can be controlled by adjusting the height of the tang frame 42 in this manner. Subsequent operation can be carried out in the same manner as described for the preceding embodiment. That is, the tip of the bit may be brought in contact with the lapping element surface 29 under the desired specific conditions.

Figure 12:
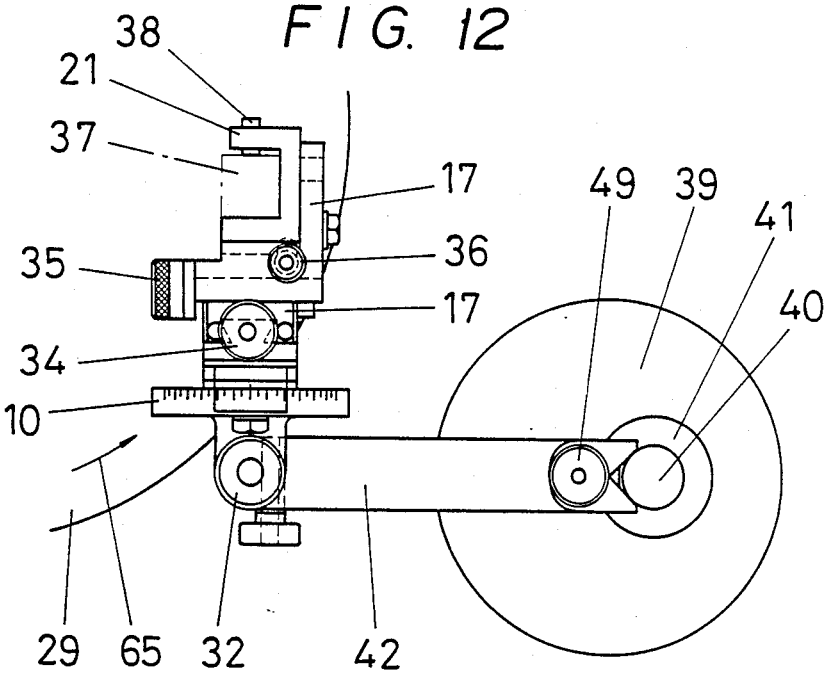
FIG. 12 is a plan view of the tang shown in FIG. 4, showing the tang swiveled about 90 degrees to the right.
Figure 13:
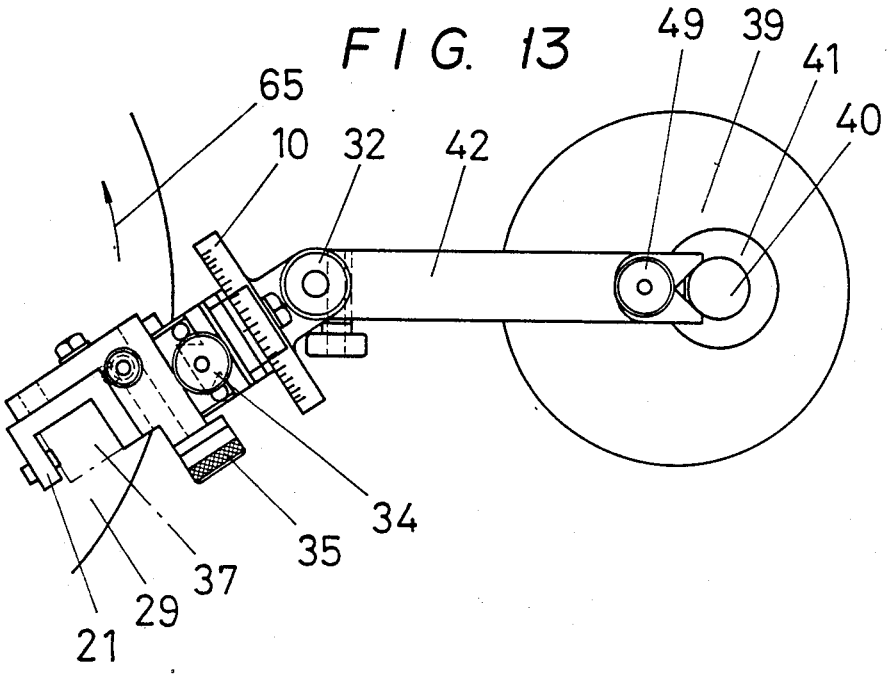
FIG. 13 is also a plan view of the tang, showing it swiveled about 30 degrees to the left.
Figure 14:
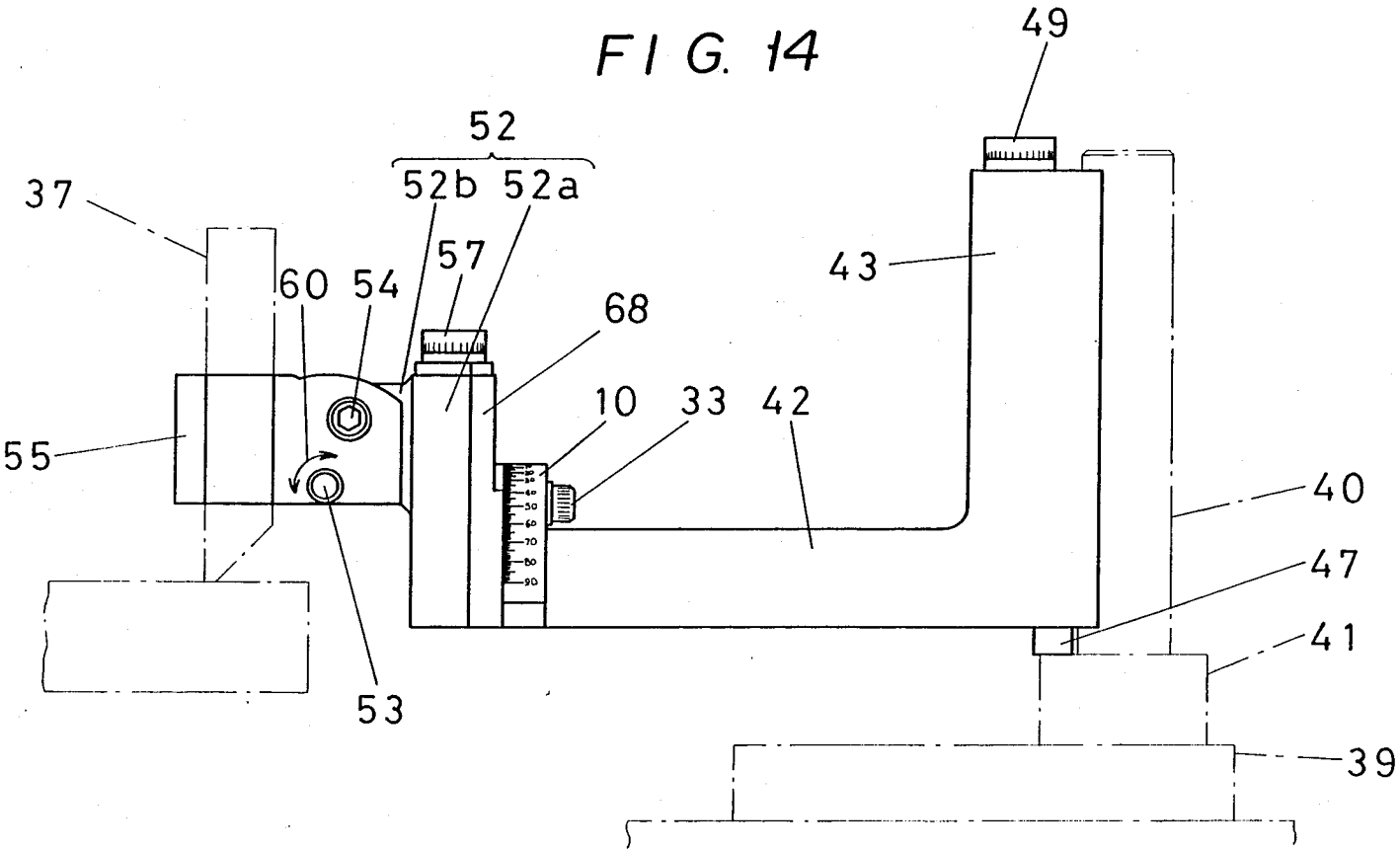
FIG.14 is a front view of a further preferred embodiment of the present invention.

The possible uses of the tang described above are illustrated in FIGS. 12 and 13. In the example shown in FIG. 12, the tang is used so that the polishing operation occurs with the tang swivelled about 90 degrees with regard to the tang frame 42. In the example shown in FIG. 13, the tang is used so that the polishing operation occurs with the tang swivelled about 30 degrees with regard to the tang frame 42. As demonstrated by those examples, the swivel angle can be adjusted over a wide range, which allows the direction (as indicated by an arrow 65) and speed (which may vary with the distance away from the center as a result of the peripheral speed) of rotation of the lapping element surface with respect to the bit tip to be controlled. As shown in FIG. 6, the stand rod base 39 has an elongated groove 66 traversing it, in which is engaged a tightening bolt 67. The position of the stand rod base 39 can be controlled by operating this bolt 67.

Figure 15:
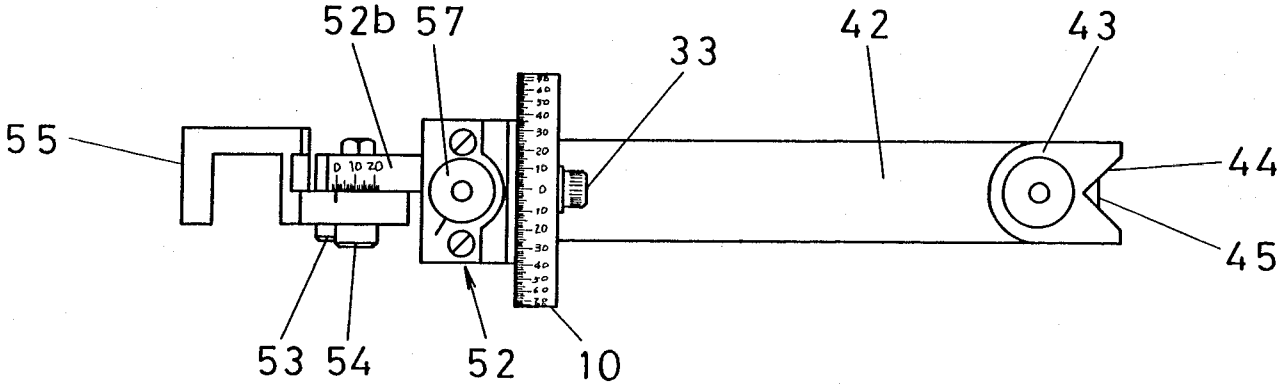
FIG. 15 is a plan view of the embodiment shown in FIG. 14.
Figure 16:
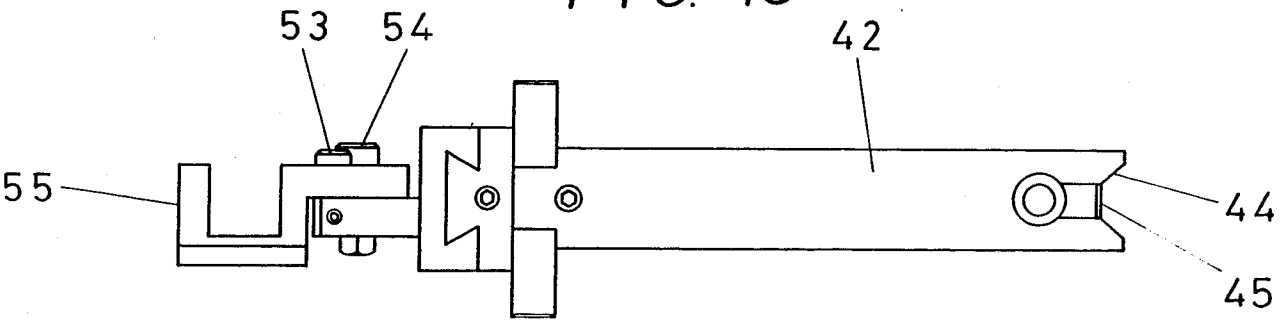
FIG. 16 is a bottom view of the embodiment shown in FIG. 14.
Figure 18:
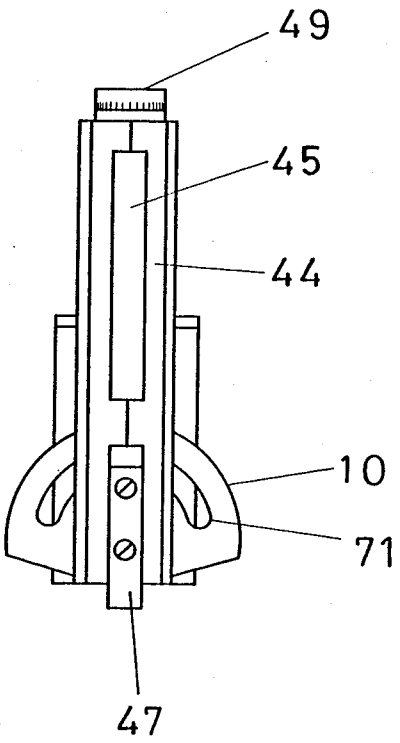
FIG. 18 is a side view of the embodiment shown in FIG. 14, as seen from the right.
Figure 17:
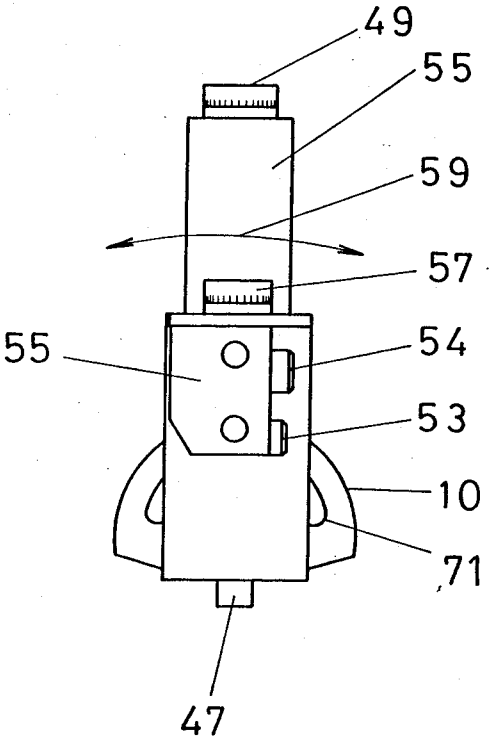
FIG. 17 is a side view of the embodiment shown in FIG. 14, as seen from the left.
Figure 19:
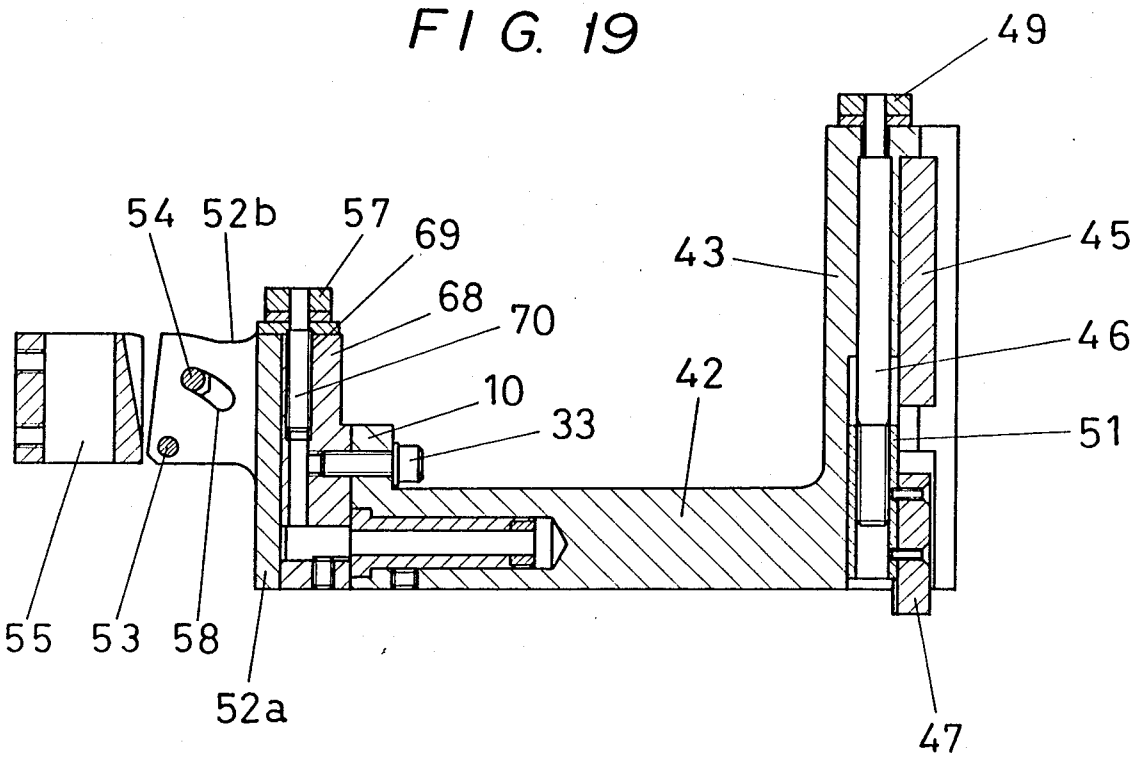
FIG. 19 is a cross-section of the embodiment shown in FIG. 14.

FIGS. 14 through 19 illustrate a further preferred embodiment of the present invention. The tang column construction includes a disk-like stand rod base 39, on which a vertical stand rod 40 is disposed. The stand rod 40 has a collar 41 at its base, which is fitted around the stand rod 40. A tang frame 42 has a longitudinally extending stand frame 43 on one side, and the stand frame 43 has a V-cut groove 44 running longitudinally on the side facing the stand rod 40 (FIG. 15). The stand frame 43 engages the stand rod 40 by means of the V-cut groove 44. Magnets 45 are housed inside the V-cut groove 44. As the stand rod 40 is made of ferromagnetic material, those magnets attract the stand rod 40 magnetically. Thus, the stand rod 40 and stand frame 44 can be joined together by the magnetic attraction. The stand rod 43 houses a vertical rod 46 through the center of the stand rod 43, whose lower threaded portion engages a threaded tube 51. On one side of the threaded tube 51 (the side on which the V-cut groove is located), a slide key 47 is fixed to the threaded tube 51 so that it can slide vertically. On the other side of the tang frame 42 opposite the stand frame 43, an arc-like protractor 68 is connected to the tang frame 42. The protractor 68 has a longitudinal groove 69 through which a mounting bolt 70 is inserted. A bracket 52 has a longitudinal rod 52*a* by which the bracket 52 is secured to the protractor 68. The bracket 52 has a lateral rod 52*b*, to which one side of the work holder 55 is secured by means of a pin 53 and a mounting bolt 54. The bit 37 is thus held by the work holder 55. A cutting depth dial 49 is provided to cause the slide key to travel up and down, a dial 57 is provided to cause the lateral rod 52*b* to move up and down, and an arc-like elongated aperture 58 provided in the lateral rod 52*b* engages the mounting bolt 54. The work holder 55 can swivel about the pin 53, and thus the desired swivel angle can be obtained.

For the above-described embodiment, the height of the tang frame 42 as a whole can be adjusted by raising or lowering the slide key 47. Loosening the tightening bolt 33 allows the bracket 52 to swivel to the right or left (as indicated by an arrow 59 in FIG. 17) freely within the range of the groove 71. When any desired swivel angle is obtained, the bolt 33 is retightened to maintain the bracket 52 at this angle. The tip of the bit 37 can be cut to any desired form by causing the work holder 55 to swivel about the pin 53 as indicated by an arrow 60 in FIG. 14.

The section including the work holder 55 can be used interchangeably in the constructions in the first and second embodiments by detaching the work holder section from the section including the swivel shaft. This is because the work holder section has the identical construction for both of the embodiments.

Figure 20:
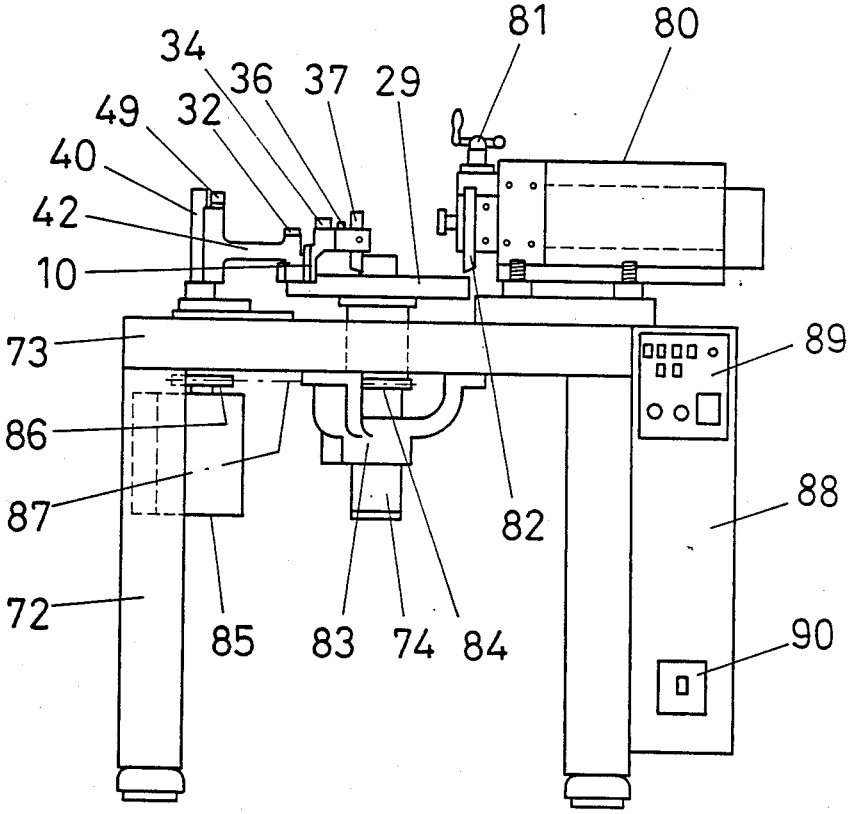
FIG. 20 is a front view of the grinding and polishing machine which is used with the apparatus according to the present invention.
Figure 21:
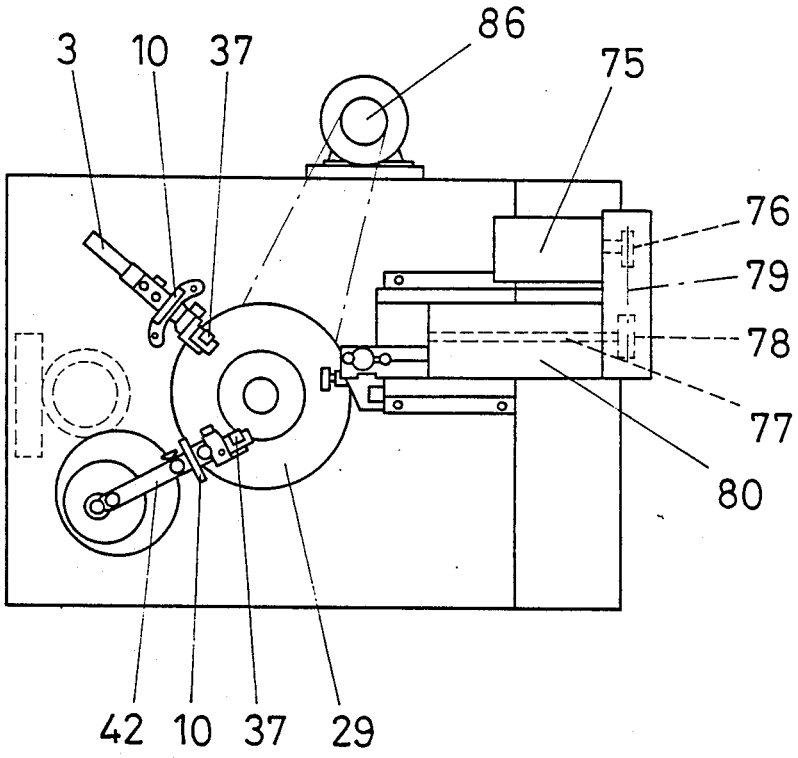
FIG. 21 is a plan view of the machine of FIG. 20.

FIGS. 20 and 21 illustrates the grinding and polishing machine that may be used with the various forms of the tang described heretofore.

The machine includes a pedestal 72, on which a work table 73 rests. On the center of the table 73 is disposed a lapping element 29 which is rotatably supported by a vertical main spindle 74 traversing the table 73. A lap trueing drive motor 75 is mounted on one side of the table 73, and has its output pulley 76 connected to the pulley 78 on a feed screw 77 by means of a belt 79. Other associated parts include a carriage 80, a cutting-depth handle 81, and a lap trueing bit 82. The portion of the main spindle 74 traversing the table 73 is supported by the spindle bracket 83 below the table 73. A spindle drive motor 85 is mounted to the pedestal 72, and has its output pulley 86 connected to the pulley 84 on the spindle 74 by means of a belt 87. A machine control section is provided beside the pedestal, and includes a control box 88, a control panel 89, and a main siwtch 90. The machine is started by turning on the drive motor 85, which drives the spindle 74 for rotation, which in turn causes the lapping element 29 to rotate. Then, the bit polishing operation can take place as described by referring to FIGS. 11 through 13. The lap surface trueing can be done by starting up the motor 75 and then moving the bit 82 forward or backward, thereby giving a proper cutting depth to the bit.

What is claimed is:

1. A tool holding apparatus for a grinding and polishing machine, comprising:

a support member adapted to be mounted on a work table of the grinding and polishing machine, and including means attached to said support member for providing said support member vertical movement;

a swing arm member mounted on said support member; and a tool holder bracket mounted on said swing arm member for rotation about a horizontal axis, and having a tool holder for holding a tool for being ground and polished, and a horizontal shaft between said tool holder bracket and said tool holder extending transversely to said horizontal axis for mounting said tool holder on said tool holder bracket for swinging movement of said tool holder around said horizontal shaft, said tool holder bracket having means attached thereto for providing vertical movement of said tool holder bracket relative to said swing arm.

2. The apparatus of claim 1, wherein said means for providing said support member vertical movement and said means for providing vertical movement of said tool holder bracket relative to said swing arm member each comprises a threaded shaft means with a dial means attached thereto.

3. The apparatus of claim 2, wherein said threaded shaft means of said support member comprises a threaded tube, a vertical rod disposed therein, and a slide key fixedly attached to said threaded tube.

4. The apparatus of claim 2, wherein said tool holder bracket includes means for adjustably fixing the swinging movement of said tool holder around said horizontal shaft.

* * * * *

UNITED STATES PATENT AND TRADEMARK OFFICE

CERTIFICATE OF CORRECTION

PATENT NO. : 4,748,775

DATED : June 7, 1988

INVENTOR(S) : Takahiro IMAHASHI

It is certified that error appears in the above—identified patent and that said Letters Patent is hereby corrected as shown below:

On the face of the Patent, under item "[73]", please delete: "Assignee: Suzuki Shoji Patent Office"

Signed and Sealed this

Thirteenth Day of December, 1988

*Attest:*

DONALD J. QUIGG

*Attesting Officer*

*Commissioner of Patents and Trademarks*